US007458877B2

(12) United States Patent
Yu

(10) Patent No.: US 7,458,877 B2
(45) Date of Patent: Dec. 2, 2008

(54) STRUCTURE OF BRA MADE BY MEANS OF HOT-PRESS SHAPING AND METHOD FOR HOT-PRESSING TO SHAPE A BRA

(76) Inventor: Li-Man Yu, 9F, No. 502, Mingshuei Rd., Jhongshan District, Taipei City (TW)

( * ) Notice: Subject to any disclaimer, the term of this patent is extended or adjusted under 35 U.S.C. 154(b) by 157 days.

(21) Appl. No.: 11/353,117

(22) Filed: Feb. 14, 2006

(65) Prior Publication Data

US 2007/0190896 A1 Aug. 16, 2007

(51) Int. Cl.
*A41C 3/10* (2006.01)

(52) U.S. Cl. ..... 450/39; 450/57; 450/92; 450/93

(58) Field of Classification Search ..... 450/39–45, 450/54–57, 51, 52, 92, 93, 46, 47, 49; 2/243.1, 2/267, 268; 156/73.1, 73.3, 60, 73.4, 88.1, 156/245; 264/152–155, 157, 163, 257, 143, 264/258, 148, 291, 160, 292, 294, 320, 321
See application file for complete search history.

(56) References Cited

U.S. PATENT DOCUMENTS

| | | | | |
|---|---|---|---|---|
| 3,202,565 | A * | 8/1965 | Loftin | 428/175 |
| 6,837,771 | B2 * | 1/2005 | Falla | 450/39 |
| 6,966,815 | B2 * | 11/2005 | Weinerth | 450/41 |
| 7,241,199 | B2 * | 7/2007 | Huang | 450/39 |

* cited by examiner

*Primary Examiner*—Gloria Hale
(74) *Attorney, Agent, or Firm*—Rosenberg, Klein & Lee

(57) ABSTRACT

A bra includes a pair of foam cups, and outer and inner layers each having two cup-shaped portions and rear pieces; each of the outer and the inner layers includes a piece of elastic cloth, and a thin foam layer joined to the elastic cloth by hot pressing; the pair of foam cups include two foam layers joined by hot pressing, and each has a steel ring wrapped between the foam layers; a bra main body is made by positioning the outer layer, the pair of foam cups, and the inner layer one over another in sequence, and hot pressing with a mold to join the outer layer, the pair of foam cups, and the inner layer together; after the last hot pressing step, a circumferential edge of the bra main body is cut to a desired shape.

8 Claims, 4 Drawing Sheets

STRUCTURE OF BRA MADE BY MEANS OF HOT-PRESS SHAPING AND METHOD FOR HOT-PRESSING TO SHAPE A BRA

BACKGROUND OF THE INVENTION

1. Field of the Invention

The present invention relates to a bra made by means of hot-press shaping, more particularly one, which is structured in such a way as to reduce the manufacturing cost.

2. Brief Description of the Prior Art

People's demand for quality is increasing with heightening of living standard. For instance, besides protecting the wearer's breasts and maintaining the shape of the breasts, a good bra is supposed to be comfortable, aesthetic, and capable of helping adjust the shape of the wearer's breasts'.

In order to prevent discomfort caused by wearing a bra, non-stitch bras are available. A common method for making a non-stitch bra includes the following steps:

(a) hot pressing to shape a first layer: an outer elastic cloth layer is made, which has substantially the same shape as a spread main body of a bra, by means of cutting; a foam and a thin piece of adhesive mesh are joined to a middle portion of the outer elastic cloth layer by means of hot pressing so that the middle portion has a plate-shape;

(b) hot pressing to shape a second layer: two ringed straps, each of which has a steel ring therein, are secured on an inner side of a piece of non-elastic cloth with an upper portion thereof cut to have two concavities to fit the curvature of the ringed straps; a thin piece of adhesive mesh is positioned between the piece of non-elastic cloth and an inner side of the outer elastic cloth layer, and the piece of non-elastic cloth and the outer elastic cloth layer are joined by means of hot pressing;

(c) hot pressing to shape a third layer: a thin piece of adhesive mesh is positioned between an inner side of the joined-together first and second layers and an elastic lining having the same shape as the outer elastic cloth layer, and the elastic lining is joined to the inner side of the joined together first and second layers by means of hot pressing;

(d) hot pressing to form cups: two cups are formed on the joined-together first, second and third layers, which have a plate shape owing to the above hot pressing actions, by means of another hot pressing with a mold in the shape of dual-cup;

(e) cutting: the semi-finished bra made in the above steps is cut to remove redundant circumferential edge portions; and (f) finishing making a main body of the bra.

From the above description, it can be seen that there is a complicated glue applying process to carry out for sticking the various parts of the bra together according to the above method. Consequently, it takes relatively much time to make such bra, and the manufacturing cost will be relatively high.

SUMMARY OF THE INVENTION

It is a main object of the invention to provide an improvement on a bra to overcome the above-mentioned problems. The bra of the present invention includes a pair of foam cups, and outer and inner layers each having two cup-shaped portions and rear pieces. Each of the outer and the inner layers includes a piece of elastic cloth, and a thin foam layer joined to the elastic cloth by hot pressing. The pair of foam cups include two foam layers joined by hot pressing, and they each have a U-shaped steel underwire wrapped between the foam layers. A main body of the bra is made with two cups and rear pieces connected to the cups by means of positioning the outer layer, the pair of foam cups, and the inner layer over one another in sequence, and hot pressing with a mold to join the outer layer, the pair of foam cups, and the inner layer together; after hot pressing, a circumferential edge of the bra main body is cut to a desired shape.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
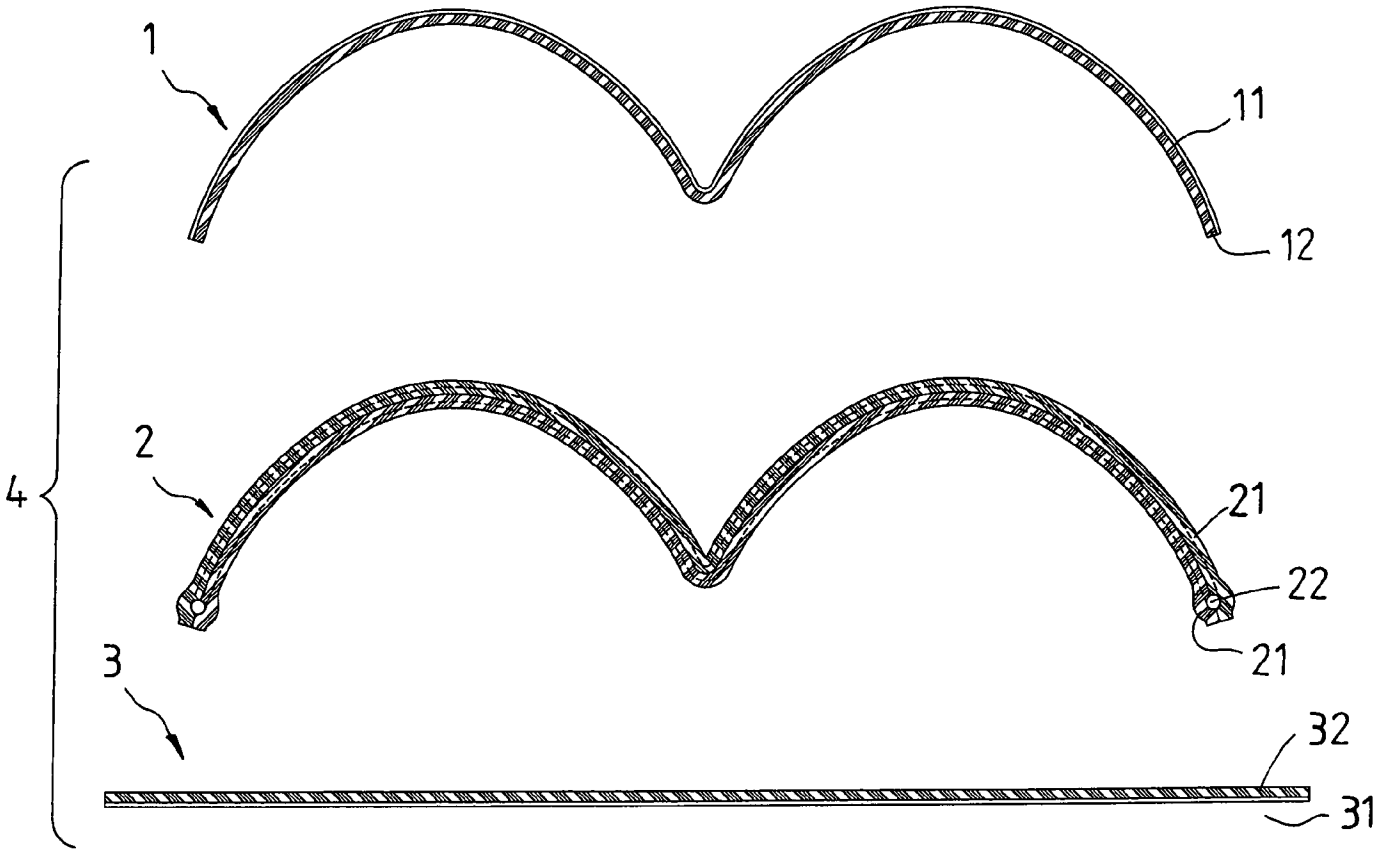
FIG. 1 is a view of the bra of the present invention under the assembling process.
Figure 2:
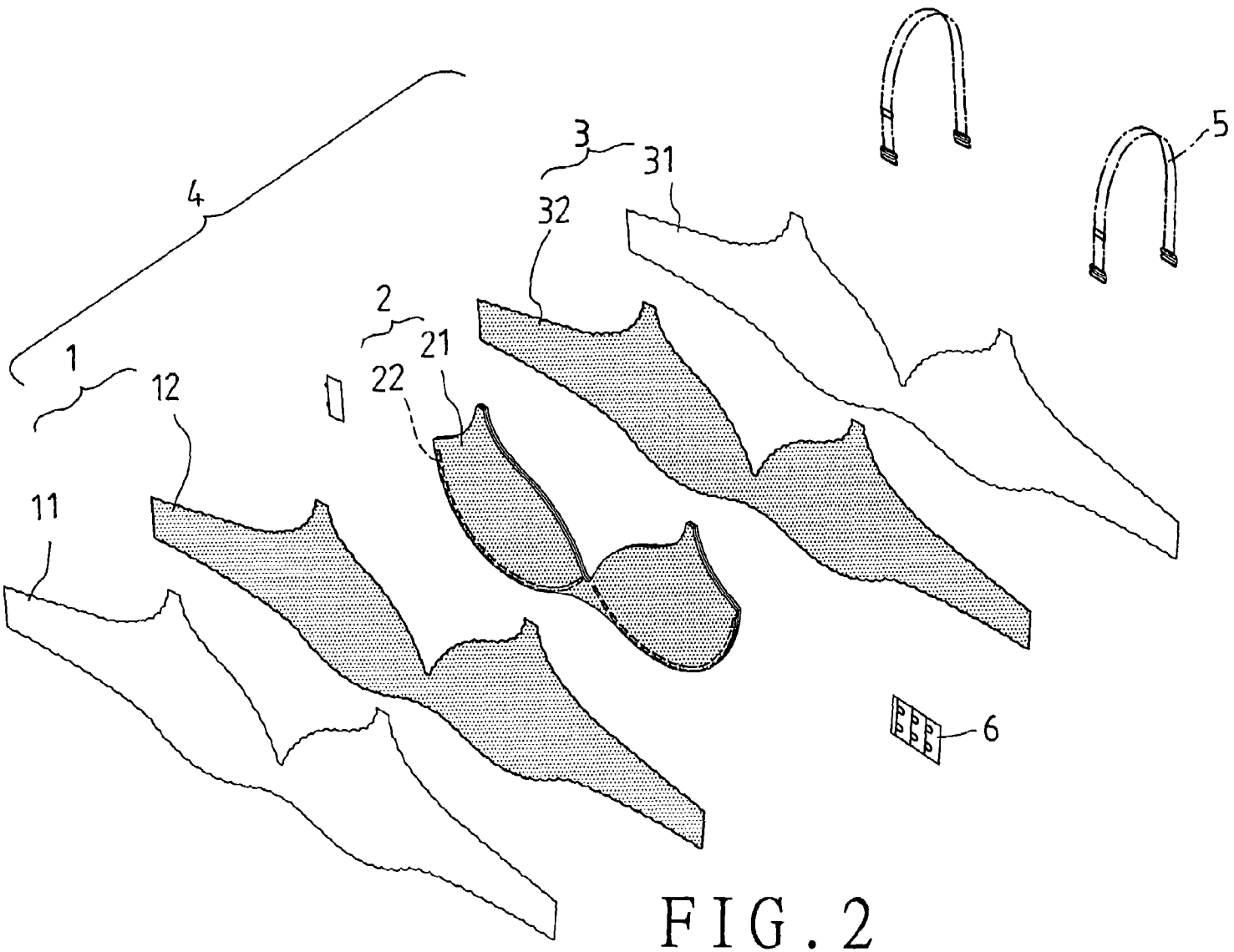
FIG. 2 is an exploded perspective view of the bra of the invention.
Figure 3:
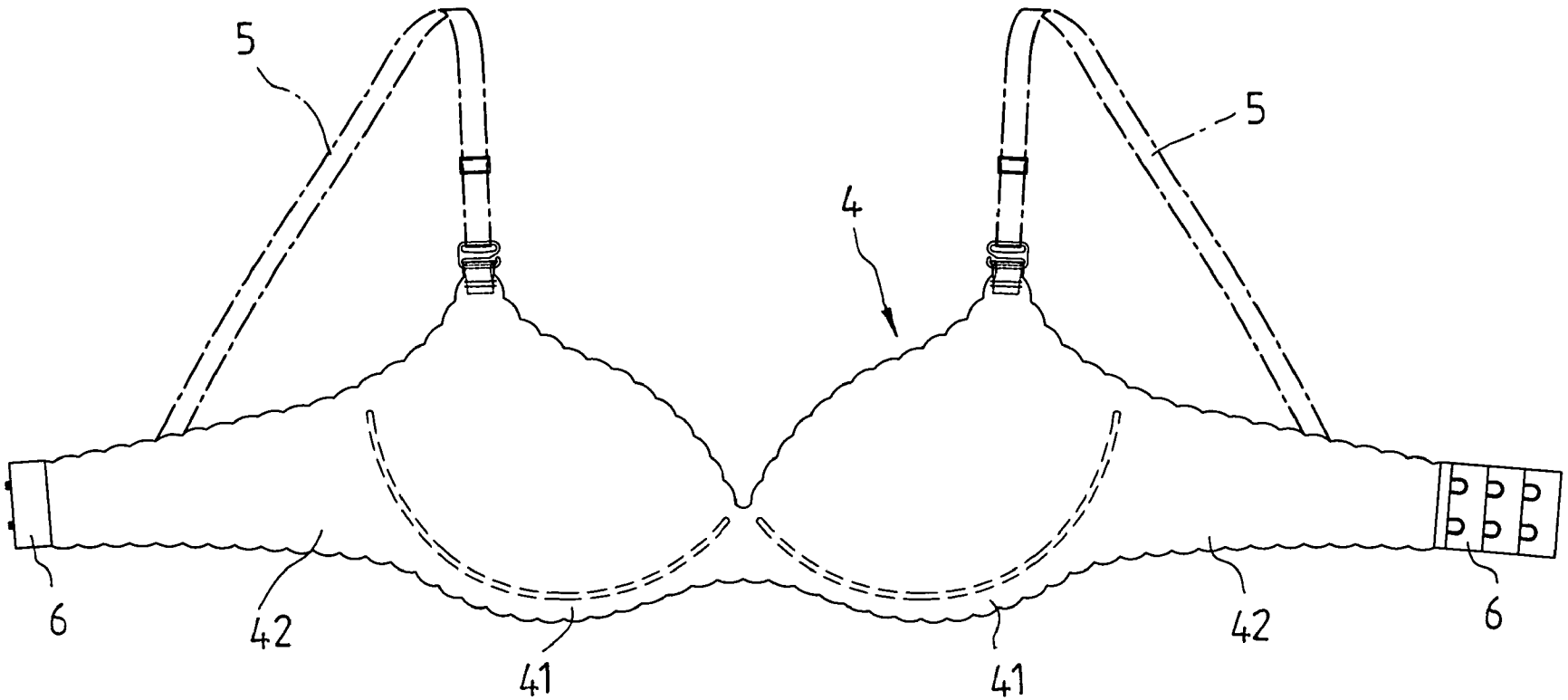
FIG. 3 is a front view of the bra of the present invention.
Figure 4:
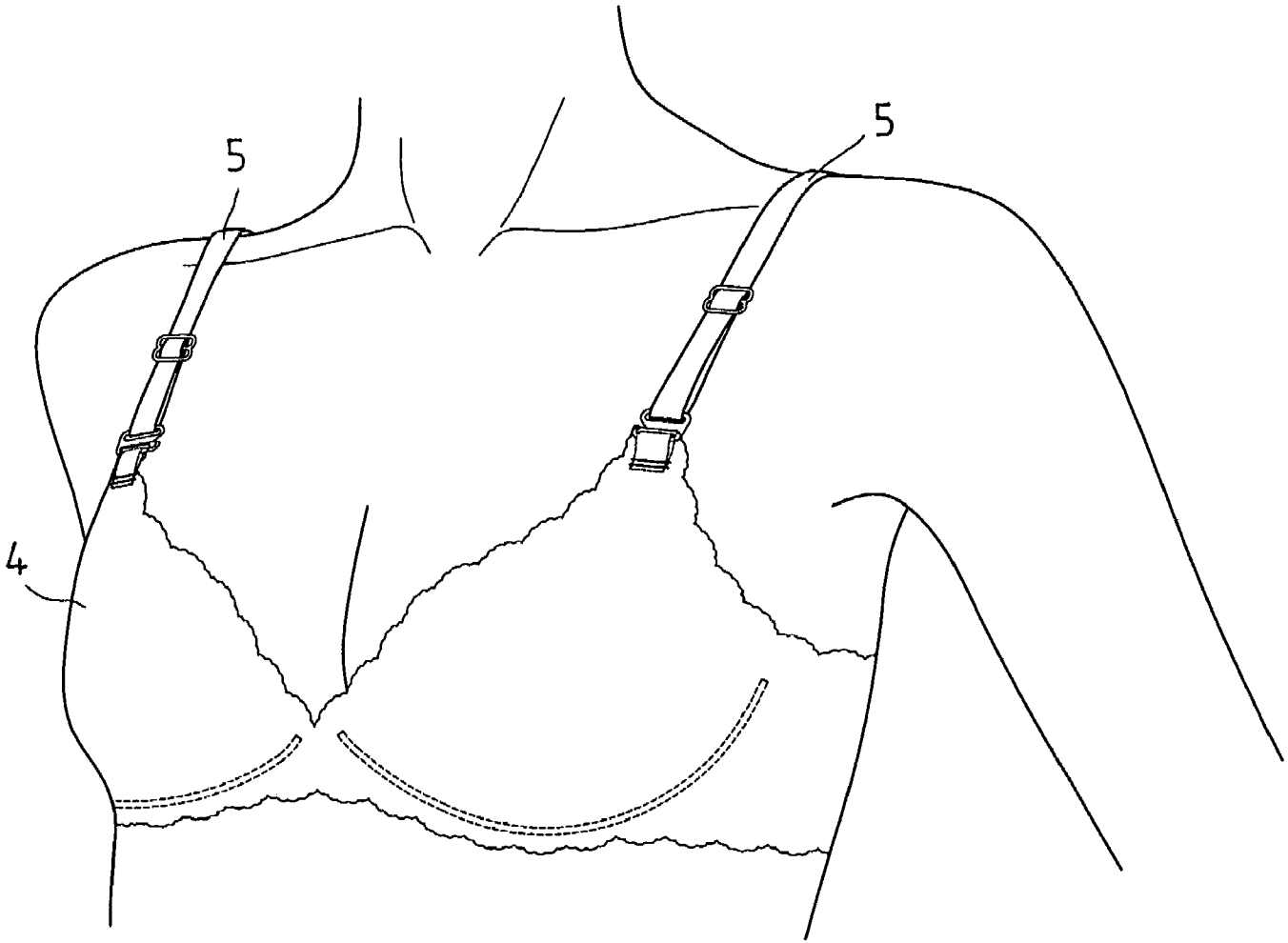
FIG. 4 is a view of the bra of the present invention in use.

Referring to FIGS. 1 to 4, a preferred embodiment of a bra made by means of hot-press shaping in the present invention includes:

an outer layer part 1, the outer layer part 1 includes an outer elastic cloth layer 11, and a thin foam layer 12; the thin foam layer 12 is positioned over an inner side of the outer elastic cloth layer 11, and joined to the outer elastic cloth layer 11 by means of carrying out hot pressing with a mold in the shape of dual-cup; thus, the outer layer part 1 is formed with two cup-shaped portions;

A pair of connected dual-layer foam cups 2, which are smaller than the dual-cup outer layer part 1 in size, the pair connected dual-layer foam cups 2 each includes two foam layers 21, and a U-shaped steel underwire 22 wrapped between the two foam layers 21 thereof; the foam layers 21 with the U-shaped steel underwire ring 22 therein are positioned and heated in a cup shaping mold to make the pair of dual-layer foam cups 2 with a fixed three-dimensional cup shape; and an inner layer part 3 larger than the pair of dual-layer foam cups 2 in size, the inner layer part 3 includes an inner elastic cloth layer 31, and a thin foam layer 32, which is positioned over a front side of the inner elastic cloth layer 31, and joined to the inner elastic cloth layer 31 by means of carrying out hot pressing with a hot-pressing mold.

In assembly, first the dual-cup outer layer part 1, the pair of dual-layer foam cups 2, and the inner layer part 3 are positioned one over another in sequence, and oil-based glue is sprinkled over opposed sides of the dual-cup outer layer part 1 and the pair of dual-layer foam cups 2 as well as opposed sides of the pair of dual-layer foam cups 2 and the inner layer part 3. Next, the dual-cup outer layer part 1, the pair of dual-layer foam cups 2, and the inner layer part 3 are positioned in a mold and joined together by means of hot pressing. And, after joined together, they are cut to remove redundant circumferential edge portions and to form a circumferential pattern by means of ultrasonic wave; thus, a semi-finished bra 4 is made, which includes two cups 41, and two rear pieces 42 connected to respective ones of outer ends of the cups 41. Next, shoulder straps 5 are sewn to upper edges of the cups 41 as well as the rear pieces 42 while fasteners 6 are secured to rear ends of the rear pieces 42; thus, the bra of the present invention is made.

From the above description, it can be seen that the present invention has the following advantages:

1. The bra of the present invention doesn't have any seams on the main body, and is comfortable to wear because it is assembled by means of hot pressing.

2. The dual-cup outer layer part, the pair of dual-layer foam cups, and the inner layer part can, after oil-base glue is sprinkled over the opposed sides thereof, be directly joined together by means of hot pressing because the thin foam layers of both the inner and the outer layer parts will become sticky when heated; the glue-applying step takes less time. Consequently, it will take less time to make the bra of the present invention.

3. The outer elastic cloth layer and the thin foam layer of the dual-cup outer layer part are joined together without using glue because the thin foam layer will become sticky when heated. And, the inner elastic cloth layer and the thin foam layer of the inner layer part are also joined together without using glue because the thin foam layer will become sticky when heated. Consequently, it saves the manufacturers the conventional glue-applying step, and it takes less time to make the bra of the present invention.

What is claimed is:

1. Structure of a bra made by means of hot-press shaping, comprising an outer layer part; with two cup-shaped portions and rear pieces connected to outer ends of the cup-shaped portions on opposing sides thereof, the outer layer part includes an outer elastic cloth layer, and a thin foam layer contiguously located with an inner side of the outer elastic cloth layer and joined to the outer elastic cloth layer by means of hot pressing;

a pair of dual-layer foam cups, the pair of dual-layer foam cups including two foam layers joined together by means of hot pressing; said pair of dual-layer foam cups each having an underwire between the two foam layers thereof; and an inner layer part with two cup-shaped portions and rear pieces connected to opposing ends of the cup-shaped portions, the inner layer part includes an inner elastic cloth layer, and a thin foam layer positioned over the inner elastic cloth layer and joined to the inner elastic cloth layer by means of hot pressing;

whereby a bra main body with two cup portions as well as rear pieces connected to opposing ends of the cup portions is formed by positioning said outer layer part, said pair of dual-layer foam cups, and said inner layer part sequentially, and applying oil-based glue over opposing sides of said dual-cup outer layer part and said pair of dual-layer foam cups as well as opposed sides of said pair of dual-layer foam cups and said inner layer part, and hot pressing with a mold to join said dual-cup outer layer part, said pair of dual-layer foam cups, and said inner layer part together.

2. The structure of a bra made by means of hot-press shaping as recited in claim 1, wherein shoulder straps are sewn to upper edges of the cup portions as well as the rear pieces.

3. The structure of a bra made by means of hot-press shaping as recited in claim 1, wherein fasteners are secured to rear ends of the rear pieces.

4. The structure of a bra made by means of hot-press shaping as recited in claim 1, wherein the bra is formed into an arcuate contour to circumferentially lie about a wearer's torso.

5. A method for constructing and shaping a multi-layer, heat laminated brassiere, comprising the steps of:

(a) establishing an outer layer part with two cup-shaped portions;

(b) positioning a thin foam layer on an inner side of an outer elastic cloth layer in contiguous relation therewith;

(c) joining the thin foam layer and the outer elastic cloth layer by means of hot pressing with a mold with cup-shaped portions;

(d) establishing a pair of dual-layer foam cups;

(e) positioning said pair of dual layer foam cups in contiguous relation to each other, and locating an underwire between said two foam cup layers joining said two foam layers by hot pressing to make a pair of cups;

(f) providing an inner layer part which is larger than said pair of dual-layer foam cups; said inner layer part defining a thin foam layer positioned on a frontal side of an inner elastic clot layer, said thin foam layer and the inner elastic clot layer being joined together by means of hot pressing wit a mold;

(g) joining said outer layer part, said pair of dual-layer foam cups, and said inner layer part together in sequential and overlying relation;

(h) sprinkling an oil-based glue over contiguous surfaces of said outer layer part and said pair of dual-layer foam cups as well as contiguous surfaces of said inner layer part;

(i) hot pressing said outer layer part, said pair of dual-layer foam cups, and said inner layer part together;

(j) cutting said outer layer part, said pair of dual-layer foam cups, and said inner layer to form a bra having two cup portions as well as rear pieces connected to outer ends of the cup portions.

6. The method as recited in claim 5, wherein shoulder straps are sewn to upper edges of the cup portions as well as the rear pieces.

7. The method as recited in claim 5, wherein fasteners are secured to rear ends of the rear pieces to provide a rear brassiere closure.

8. The method as recited in claim 5, wherein the bra is formed into an arcuate contour to circumferentially lie about a wearer's torso.

* * * * *